United States Patent [19]

Flandre

[11] Patent Number: 4,893,681

[45] Date of Patent: Jan. 16, 1990

[54] FIREFIGHTING INSTALLATION FOR FLOATING ROOF HYDROCARBON STORAGE TANKS

[76] Inventor: Rene Flandre, 495 rue du II Novembre, Zone Industrielle, 76650 Petit Couronne, France

[21] Appl. No.: 250,763

[22] Filed: Sep. 29, 1988

[51] Int. Cl.[4] ..... A62C 3/12

[52] U.S. Cl. ..... 169/66; 169/68; 169/14; 239/568

[58] Field of Search ..... 169/66, 68, 67, 70, 169/5, 14–16, 44, 49; 239/548, 553, 566, 568, 597–599, 104, DIG. 23

[56] References Cited

U.S. PATENT DOCUMENTS

| | | | |
|---|---|---|---|
| 1,593,500 | 7/1926 | Mantell | 239/548 X |
| 3,876,010 | 4/1975 | Blomquist et al. | 169/68 X |

FOREIGN PATENT DOCUMENTS

| | | | |
|---|---|---|---|
| 2552336 | 3/1985 | France . | |
| 2613631 | 10/1988 | France | 169/15 |
| 1202596 | 1/1986 | U.S.S.R. | 169/66 |
| 260262 | 6/1927 | United Kingdom | 169/68 |

*Primary Examiner*—Sherman D. Basinger
*Assistant Examiner*—James M. Kannofsky
*Attorney, Agent, or Firm*—Sandler & Greenblum

[57] ABSTRACT

A firefighting installation for floating roof hydrocarbon storage tanks comprises a series of vertical pipes disposed regularly around the tank. A sprayer at the top of each pipe is adapted to form a flat jet of extinguishing foam directed towards the interior of the tank along its inside wall. A pressurized water supply is connected to the pipes through an emulsifying agent feed system. An air injector on each pipe near the sprayer favors the formation of the foam. Each sprayer includes two nozzles set at an angle to each other and directed towards the floating roof. Each nozzle incorporates a longitudinal slot in its end portion opposite the free end and facing towards the floating roof.

4 Claims, 2 Drawing Sheets

FIREFIGHTING INSTALLATION FOR FLOATING ROOF HYDROCARBON STORAGE TANKS

BACKGROUND OF THE INVENTION

1. Field of the Invention

The present invention concerns firefighting installations for floating roof hydrocarbon storage tanks.

2. Description of the Prior Art

French patent No. 83 15 140 of 23 Sept. 1983 describes an installation for fighting fires in floating roof storage tanks, said installation comprising a series of vertical pipes disposed regularly around the storage tank and connected to a pressurized water supply through emulsifying agent feed means, each pipe carrying at its free end a sprayer including a backplate into which the free end of the pipe discharges and a cover plate substantially parallel to the backplate, a dispensing slot being formed between the backplate and the cover plate between which deflectors are inserted.

Following numerous trials, various installations have been provided with an arrangement of this kind which are functioning perfectly, but in the case of very large storage tanks sprayers of this kind cannot be used as they must be placed near the upper edge of the tanks and very large storage tanks incorporate a floating roof which projects beyond the upper edge when they are full.

The invention is directed to a new sprayer which can be disposed at a height such that it does not impede upward movement of the floating roof but which nevertheless directs a flat jet of foam along the inside wall of the tank.

SUMMARY OF THE INVENTION

The present invention consists in a firefighting installation for floating roof hydrocarbon storage tanks comprising a series of vertical pipes disposed regularly around a storage tank, a sprayer at the top of each pipe adapted to form a flat jet of extinguishing foam directed towards the interior of the tank along its inside wall, a pressurized water supply connected to said pipe, emulsifying agent feed means between said water supply and said pipes, and an air injector on each pipe near said sprayer to favor the formation of the foam, wherein said sprayers include two nozzles set at an angle to each other and directed towards said floating roof and each nozzle incorporates a longitudinal slot in its end portion opposite the free end and facing towards the floating roof.

This arrangement forms a float divergent jet of foam along the inside wall of the storage tank.

Preferably, the angle between the nozzles is in the order of 120° and the ends of the nozzles opposite the free end are attached to the pipe.

The free end of each nozzle is preferably partially closed off by a cruciform member. This prevents birds entering the nozzles and building nests which could block the nozzles.

Finally, each nozzle preferably includes a cylindrical portion attached to the pipe and including the slot and a frustoconical portion between this cylindrical portion and its free end.

The invention will now be described in more detail with reference to a specific embodiment and by way of non-limiting example only, with reference to the appended diagrammatic drawings.

DESCRIPTION OF THE PREFERRED EMBODIMENT

Figure 1:
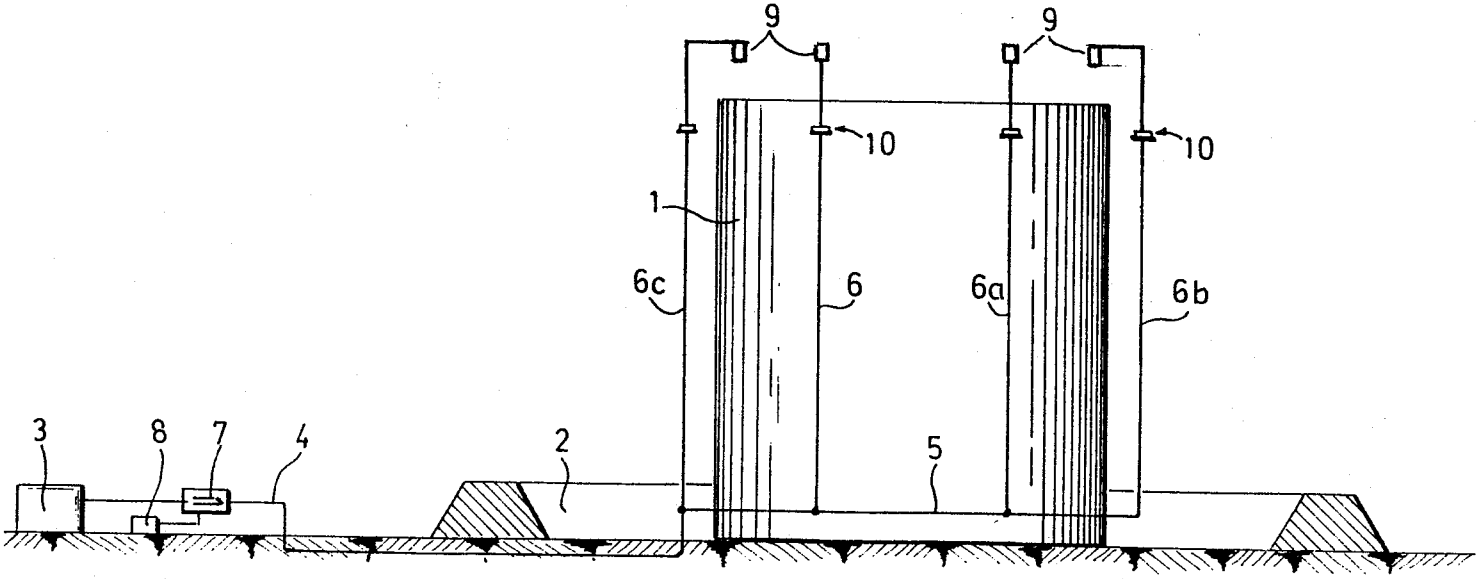
FIG. 1 is a schematic view of a firefighting installation.

FIG. 1 shows a hydrocarbon storage installation including a storage tank 1, preferably of the floating roof type, a containment tank 2 and a firefighting installation including a pump 3 drawing up water and discharging it into a pipe 4 connected to a circular pipe 5 surrounding the storage tank 1 from which rise vertical pipes 6, **6*a*, 6*b*, 6*c*, etc. The pipes 6 are designed to convey foam that has to be directed along the inside wall of the storage tank in the event of fire and are terminated by sprayers 9**.

Inserted into the pipe 4 is a venturi 7 connected to a storage tank 8 of liquid emulsifying agent, which may be a surfactant or a fluoro-protein. A specific percentage of the emulsifying agent is added to the water flowing in the pipes 4, 5 and 6.

Figure 3:
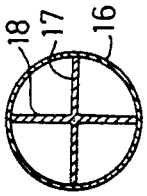
FIG. 3 is a view in a cross-section on the line III—III in FIG. 2.
Figure 4:
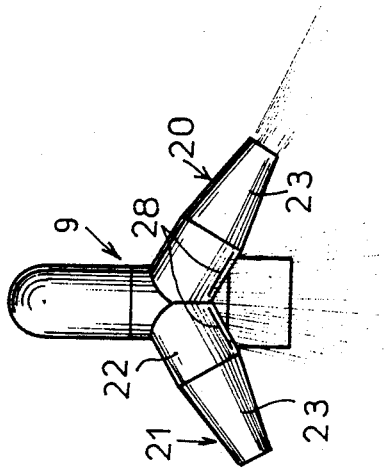
FIG. 4 is a view of the sprayer from FIGS. 2 and 3 in front elevation.
Figure 2:
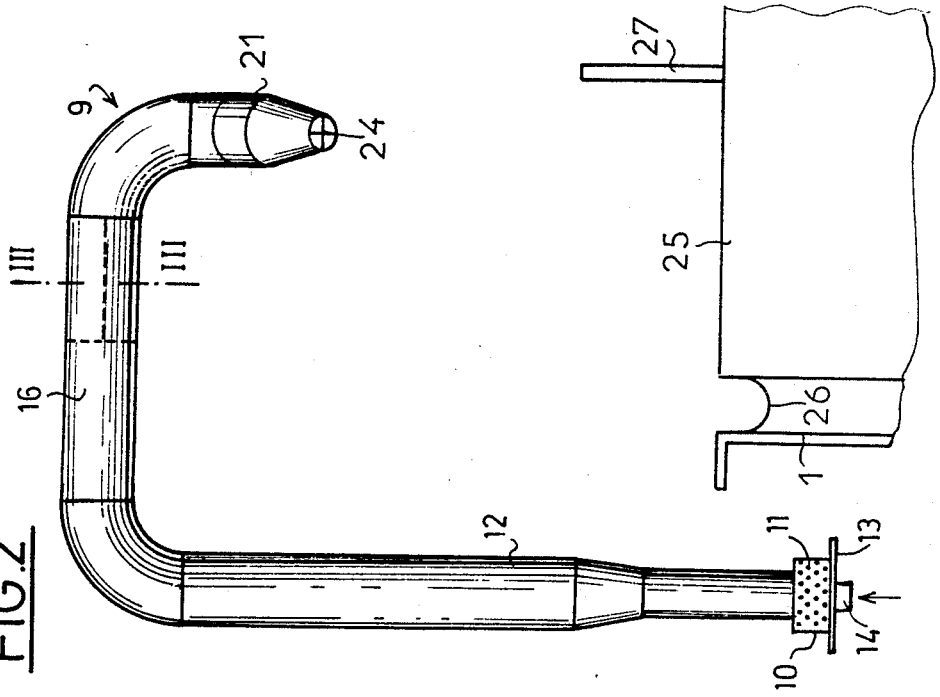
FIG. 2 is a view elevation of a sprayer in accordance with the invention.

The sprayer is shown in detail in FIGS. 2 through 4. It comprises an injector 10 formed by a cylindrical body in which are holes 11 and the upper end of which is connected to a pipe 12, while the lower end incorporates a flange 13 enabling it to be fixed to a corresponding flange on the pipes 6.

The lower part of the injector 10 incorporates vanes 14 producing a swirling motion in the water to favor the entry of air through the holes 11 to form a better emulsion and so to obtain a more dense and more effective foam:

The pipe 12 is extended by a right-angle section 16 in which are two deflectors 17 and 18 disposed diametrally and perpendicular to each other. The deflectors 17 and 18 are intended to eliminate swirling motion in the foam.

The right-angle part 16 is terminated by two nozzles 20 and 21 set at an angle of 120° to each other.

Each nozzle 20 and 21 has a substantially cylindrical portion 22 and a frustoconical portion 23 leading to its free end which is partially closed off by a cruciform member 24 to prevent birds entering the nozzle and building nests there.

As seen in FIG. 4, the floating roof 25 includes a lateral seal 26 and a wall 27 adapted to confine the foam to the part of the roof adjacent the seal 26. The cylindrical portions 22 of the nozzles 20 and 21 each comprise a slot 28 in the area facing the floating roof 25.

The foam discharged therefore forms a divergent curtain along the inside wall of the storage tank 1.

Of course, the invention is not limited to the embodiment described and shown. Numerous modifications of detail may be made to this without departing from the scope of the invention.

I claim:

1. Firefighting installation for floating roof hydrocarbon storage tanks comprising a series of vertical pipes disposed regularly around a storage tank, a sprayer at the top of each pipe adapted to form a flat jet of extinguishing foam directed towards the interior of the tank along its inside wall, a pressurized water supply connected to said pipes, emulsifying agent feed means between said water supply and said pipes, and an air injector on each pipe near said sprayer to favor the formation of the foam, wherein said sprayer include two nozzles set at an angle to each other and directed towards said floating roof and each nozzle incorporates a longitudinal slot in its end portion opposite its free end and facing towards said floating roof.

2. Installation according to claim 1, wherein the angle between said nozzles is in the order of 120° and the ends of said nozzles opposite their free ends are attached to said pipe.

3. Installation according to claim 1, wherein the free end of each nozzle is partially closed off by a cruciform member.

4. Installation according to claim 1, wherein each nozzle includes a cylindrical portion attached to said pipe and including said slot and a frustoconical portion between said cylindrical portion and its free end.

* * * * *

UNITED STATES PATENT AND TRADEMARK OFFICE

CERTIFICATE OF CORRECTION

PATENT NO. : 4,893,681

DATED : January 16, 1990

INVENTOR(S) : Rene FLANDRE

It is certified that error appears in the above-identified patent and that said Letters Patent is hereby corrected as shown below:

Column 1, line 52, change "float" to ---flat---.
Column 2, line 5, insert ---in--- after "view".
Column 3, line 5, change "sprayer" to ---sprayers---.

Signed and Sealed this

Seventeenth Day of November, 1992

*Attest:*

DOUGLAS B. COMER

*Attesting Officer*

*Acting Commissioner of Patents and Trademarks*